US007938874B2

(12) United States Patent
Auber

(10) Patent No.: US 7,938,874 B2
(45) Date of Patent: May 10, 2011

(54) DRIVEN SEPARATOR FOR GAS SEAL PANELS

(75) Inventor: Philippe Auber, Le Havre (FR)

(73) Assignee: Dresser-Rand Company, Olean, NY (US)

( * ) Notice: Subject to any disclaimer, the term of this patent is extended or adjusted under 35 U.S.C. 154(b) by 313 days.

(21) Appl. No.: 12/329,291

(22) Filed: Dec. 5, 2008

(65) Prior Publication Data

US 2010/0139776 A1 Jun. 10, 2010

(51) Int. Cl.
*B01D 46/18* (2006.01)

(52) U.S. Cl. ..... 55/405; 55/404; 55/406; 55/407; 55/408; 96/155; 96/157; 95/241; 95/264; 95/270; 210/380.1; 210/512.3; 210/784; 137/13; 137/563; 494/35; 494/49; 494/51; 494/60

(58) Field of Classification Search ..... 55/400, 55/404–408; 210/380.1, 512.3, 784; 137/13, 137/563; 96/155, 157; 95/241, 261, 270; 494/35, 49, 51, 60
See application file for complete search history.

(56) References Cited

U.S. PATENT DOCUMENTS

| | | | | |
|---|---|---|---|---|
| 2,720,313 | A * | 10/1955 | Pattison | 210/111 |
| 3,548,568 | A * | 12/1970 | Carlson, Jr. et al. | 95/218 |
| 4,278,200 | A * | 7/1981 | Gunnewig | 494/5 |
| 4,336,693 | A | 6/1982 | Hays et al. | |
| 5,385,446 | A | 1/1995 | Hays | |
| 5,525,034 | A | 6/1996 | Hays | |
| 5,664,420 | A | 9/1997 | Hays | |
| 5,685,691 | A | 11/1997 | Hays | |
| 5,693,125 | A * | 12/1997 | Dean | 96/157 |
| 5,720,799 | A | 2/1998 | Hays | |
| 5,750,040 | A | 5/1998 | Hays | |
| 5,946,915 | A | 9/1999 | Hays | |
| 6,090,299 | A | 7/2000 | Hays et al. | |
| 6,122,915 | A | 9/2000 | Hays | |
| 6,314,738 | B1 | 11/2001 | Hays | |
| 6,530,979 | B2 * | 3/2003 | Firey | 95/270 |
| 7,185,447 | B2 * | 3/2007 | Arbeiter | 34/471 |
| 7,241,392 | B2 * | 7/2007 | Maier | 210/784 |
| 7,288,202 | B2 | 10/2007 | Maier | |
| 7,674,377 | B2 * | 3/2010 | Carew | 210/298 |
| 7,846,228 | B1 * | 12/2010 | Saaski et al. | 55/406 |
| 2003/0029318 | A1 * | 2/2003 | Firey | 95/267 |
| 2007/0140815 | A1 | 6/2007 | Shinozaki | |
| 2008/0246281 | A1 * | 10/2008 | Agrawal et al. | 290/52 |

FOREIGN PATENT DOCUMENTS

WO 2010065303 6/2010

OTHER PUBLICATIONS

International Search Report for PCT/US2009/064916, dated Jan. 25, 2010, pp. 1-8.

* cited by examiner

*Primary Examiner* — Jason M Greene
*Assistant Examiner* — Dung Bui
(74) *Attorney, Agent, or Firm* — Edmonds & Nolte, PC

(57) ABSTRACT

A system and method for supplying clean dry gas to gas seals of a compressor. The system uses a rotary separator magnetically coupled to a source of rotational power, along with a gas stream cooling unit configured to condensate liquids out of a wet gas stream before the wet gas stream is supplied to the rotating separator. The system may further include a gas stream pressure booster, a heating unit to heat a dry gas stream generated by the rotary separator, and a controlled recirculation loop configured to continually recirculate the wet gas through the driven rotary separator until a desired amount of condensates are removed from the wet gas stream.

21 Claims, 4 Drawing Sheets

DRIVEN SEPARATOR FOR GAS SEAL PANELS

BACKGROUND OF THE INVENTION

Gas seal panels are generally configured to supply clean dry seal buffer gas to shaft seals of rotating compressors and turbo machinery. A gas seal panel may generally include a plurality of pressure/flow control valves, filters, and various instruments to condition, control, and monitor the gas into and out of the dry gas seals. Arranging all of the gas seal panel components in one location near the compressor or turbo machinery package simplifies the mechanical construction, process piping, and electrical installation of the gas seal panel.

Supplying clean dry gas to the gas seal panel is a challenge facing numerous industries that employ compressed gas technology. One current method for supplying clean dry gas to a gas seal panels and the associated gas seals is to utilize cryogenic expanders to remove condensates from the supply gas stream, however, cryogenic expanders require extremely low temperatures to operate effectively, which presents both cost and technical challenges to effective long term operation. Another method for cleaning a gas supply is to use gravity separators, however gravity separators are very slow and do not provide a high level of condensate removal from a gas stream. Still other methods for cleaning and drying gas supplies include use of scrubber vessels and a vane pack, an axial flow cyclone, or a bank of cartridge filters.

However, each of these conventional gas cleaning systems have inherent disadvantages. For example, each of the above noted systems requires substantial space and regular maintenance. Additionally, although each of the above noted conventional systems operates to remove moisture from the gas stream, none of these systems generally provide an impressive removal or separation efficiency, without incurring substantial space considerations.

Therefore, there is a need for an efficient, compact, and cost effective system and method for supplying clean dry gas to gas seal buffer supply lines.

SUMMARY OF THE DISCLOSURE

Embodiments of the invention generally provide an efficient, compact, an cost effective system and method for supplying clean dry gas to gas seal buffer supply lines. The system may generally include a device for cooling a gas stream, a rotary separator device, a booster device, a driving device for the rotary separator and/or booster, and a device for heating a gas stream. The system may further include a recirculation loop to provide for increased separation efficiency.

Embodiments of the invention may generally provide a system for separating condensates from a gas stream. The system generally includes a cooling unit configured to cool a gas stream to a temperature below a dew point of a liquid in the gas stream, a driven rotary separator configured to receive a gas stream from the cooling unit, and a booster in communication with the driven rotary separator and configured to increase a pressure of the gas stream. The system further includes a source of rotational force in communication with the driven rotary separator and booster, and a heating unit in communication with the booster and configured to heat the gas stream to a temperature above the dew point of the liquid, wherein the cooling unit, driven rotary separator, and booster form a gas recirculation loop.

Embodiments of the invention may further provide a method for providing clean dry gas to gas seals in machinery.

The method includes flowing a wet gas stream through a cooling unit, flowing the cooled wet gas stream through a driven rotary separator, and flowing a dry gas output from the driven rotary separator through a booster. The method further includes recirculating the dry gas stream through the cooling unit, driven rotary separator, and booster until the dry gas stream reaches a desired dryness, and flowing the dry gas stream through a heating unit after the recirculation.

Embodiments of the invention may further include a system for generating a clean dry gas to be supplied to gas seals in a compressor. The system may include a cooling means for cooling a wet gas stream to a temperature below a dew point of a liquid in the gas to generate liquid condensates in the wet gas stream, a driven rotary separator means for separating liquid condensates from the wet gas stream, the driven rotary separator being in communication with a source of rotational power, and a pressure boosting means for boosting the pressure of a dry gas stream exiting the driven rotary separator means. The system may further include a heating means for heating the dry gas stream to a temperature sufficient to convert any condensates in the dry gas stream into a gas state, and a recirculation loop for recirculating the dry gas stream back through the driven rotary separator means until a desired percentage of liquid condensates have been removed from the gas stream.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
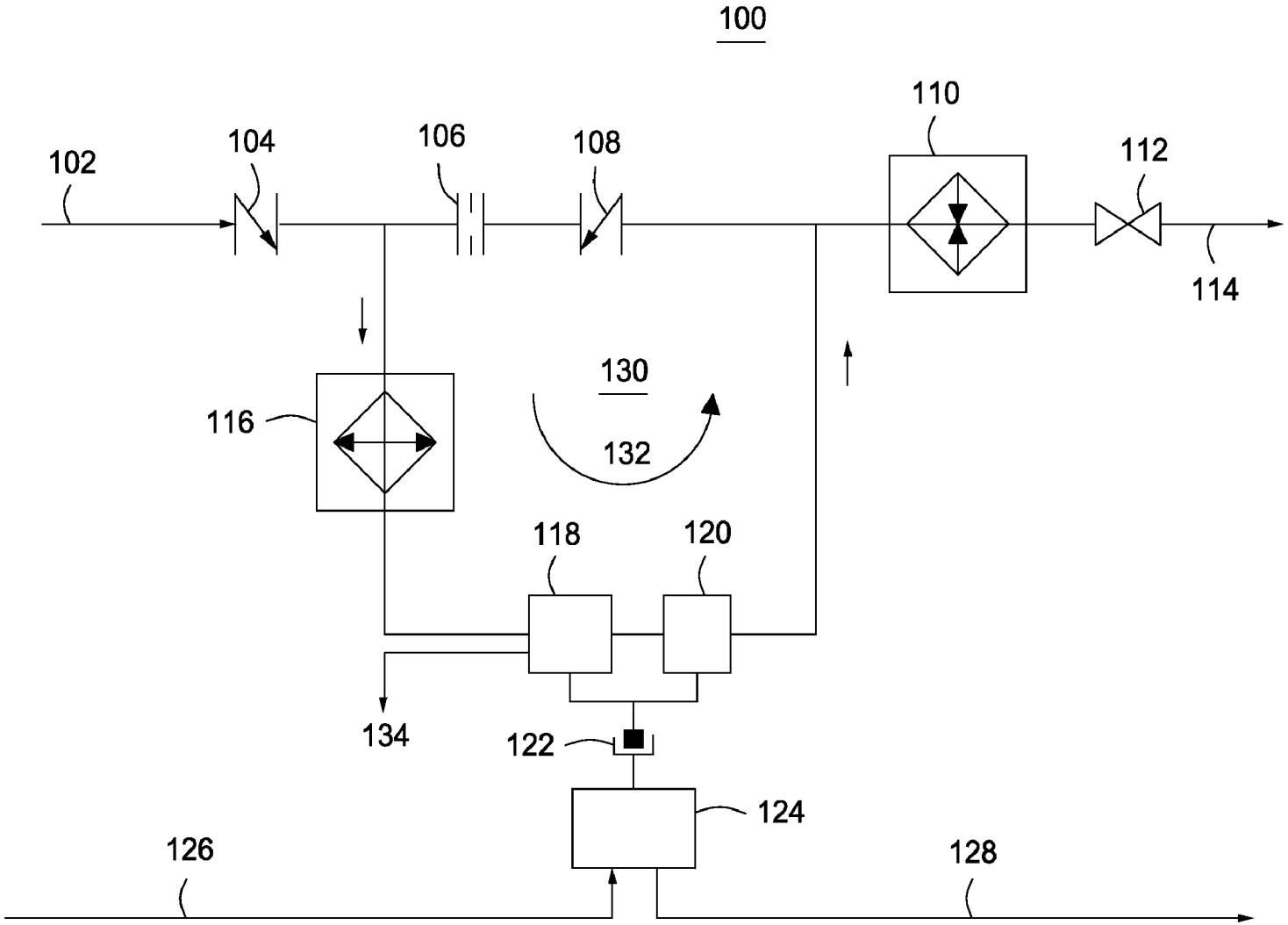
FIG. 1 illustrates a high level schematic diagram of an exemplary gas seal supply system of the invention.

It is to be understood that the following disclosure provides several exemplary embodiments for implementing different features, structures, or functions of the invention. Exemplary embodiments of components, arrangements, and configurations are described below to simplify the present disclosure, however, these exemplary embodiments are provided merely as examples and are not intended to be limiting on the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one embodiment may be used in any other embodiment, without departing from the invention.

Additionally, certain terms are used throughout the following description and claims to refer to particular components. As one skilled in the art will appreciate, various entities may refer to the same component by different names, and as such, the naming convention for the elements described herein is not intended to be limiting upon the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values. Accordingly, various embodiments of the invention may deviate from the numbers, values, and ranges disclosed herein without departing from the intended scope of the invention.

FIG. 1 illustrates a high level schematic diagram of an exemplary gas seal supply system 100 of the invention. The system 100 receives a gas supply from a gas source 102, which may be a discharge gas from another system at a gas plant. The incoming gas supply, which is generally a wet gas, is passed through a variable position valve 104, which may be a shut off valve, regulator valve, or other valve configured to control the pressure or flow of gas there through. In the exemplary embodiment illustrated in FIG. 1, the variable position valve 104 may be a normally closed-type valve that may be either manually operated or controlled by an electronic control system configured to control various components of the system 100. Once the gas passes through the valve 104, the gas enters a gas conditioning loop 130, and the flow of the gas in the conditioning loop is generally in the direction of the arrow 132. The control valve 104 may be used to regulate the gas flow. Additionally, the flow thru the loop 130 may be governed or regulated by the size and/or operation speed of the booster, which in turn operates to regulate the amount or percentage of liquid condensates removed from the wet gas stream. Thus, if a much drier gas is needed, the size and/or operational speed of the booster may be adjusted (in the design phase) to recirculate more of the wet gas through the rotary separator multiple times until the desired gas dryness is obtained.

Once the supply gas enters the conditioning loop 130, the gas is passed through a cooling unit 116. The cooling unit 116 is generally configured to cool the supply gas to a temperature sufficient to convert liquids contained in the supply gas into liquid condensates, i.e., to change the state of the gaseous liquids in the wet gas stream into liquid condensates. For purposes of the present disclosure, condensation or converting a gaseous liquid into condensates may be defined as the change of the physical state from the gaseous phase into liquid phase, which generally occurs when a vapor contained in a gas stream is cooled to a temperature at or below its dew point. Thus, the cooling unit 116 may be any suitable heat exchanger used in gas plants configured to cool a gas stream to temperatures below a vapor dew point for the liquids contained in the gas stream. Exemplary heat exchangers capable of cooling a gas supply to a dew point may utilize water, glycol, or any other cooling medium commonly used in gas plant technologies. In one exemplary embodiment of the invention, gas exiting an expander, which is a cold gas that is often readily available in a gas plant, may be utilized to cool the seal gas supply stream as it passes through cooling unit 116. Use of the readily available expander gas 124, 128 increases the overall efficiency of the gas cleaning system 100 and method of the disclosure. Regardless of the exact implementation utilized, the cooling unit 116 is generally configured to cool the gas stream to a temperature suitable to generate condensates in the gas stream. Embodiments of the invention are not intended to be limited to any particular type or configuration of cooling unit 116, and as such, the inventors contemplate that any cooling unit in the art capable of cooling a gas stream to a temperature below the gas stream's dew point may be utilized in the present exemplary embodiments.

Figure 2:
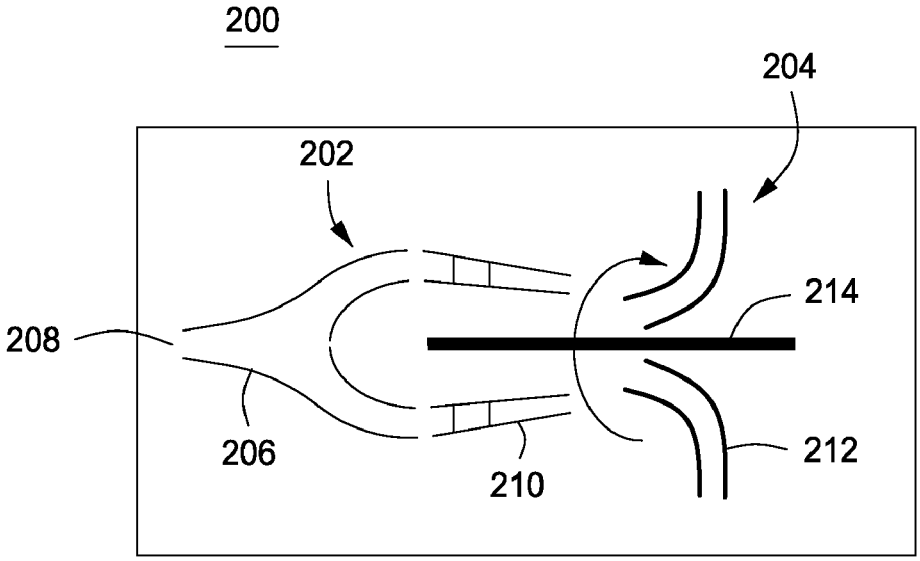
FIG. 2 illustrates a high level exemplary rotary separator and booster that may be used in the system of FIG. 1.

Once the seal supply gas is cooled, the gas may be communicated to a rotary separator system 118, which is further detailed in FIG. 2. The rotary separator system 118 is generally configured to impart a rotating or swirling motion to the gas, i.e., to spin the gas at a speed sufficient to cause the (heavier) condensates in the gas to be centrifugally separated from the dry (light) portion of the gas stream. The condensates removed from the gas stream in the rotary separator 118 may be communicated away from the rotary separator via an output conduit 134. Once the condensates are removed from the gas stream, the substantially dry gas stream may be communicated to an optional pressure boosting system 120. The boosting system 120 generally operates to increase the pressure of the supply gas. Generally speaking, the process of imparting a swirling motion to the gas stream causes a pressure drop, and as such, the boosting system 128 is used to increase the pressure of the gas stream back up to a pressure that is similar to the gas stream pressure at the inlet of the rotary separator 118, i.e., the booster 128 may compensate for the inherent pressure drop associated with passing the wet gas stream through the rotary separator and loop 130 restrictions.

In at least one exemplary embodiment of the invention, the rotary separator 118 and/or the boosting system 120 may be actively driven components of the system 100. For example, a driving component 124 may be in communication with the rotary separator 118 and/or the boosting system 122, and the driving component 124 may provide rotary force/motion thereto. The driving component 124 may be any type of device configured to generate rotary force or motion, such as an electric motor, turbine, or other device or system known in the art. However, since embodiments of the invention may be employed in a gas plant, the inventors contemplate that the driving component 124 may be an expander or turbine configured to receive a pressurized gas and generate rotational force/motion in exchange for a reduction in the pressure of the received gas. Thus, in an exemplary embodiment where the system 100 is employed at a gas plant, the supply gas 126 to the expander 124 may be from a nitrogen grid or a fuel gas, and the gas exiting 128 expander 124 may be communicated to barrier seals and/or intermediate laby seals for turbo or compressor machinery, which is generally known in the art. Additionally, the fluid 128 might be used as cooling medium in the cooler 116

Returning to the dry gas exiting the rotary separator 118 and/or the boosting system 120, when the dry gas exits the separator 118 or booster 120, the gas is communicated back into a gas recirculation loop 130. Since the gas recirculation loop 130 circulates gas in the direction of the arrow 132, the dry gas exiting the separator 118 is communicated through a valve 108, which may be selectively opened/closed to regulate flow through the recirculation loop 130.

In one exemplary embodiment of the invention, the gas flow entering system 100 may be circulated through the recirculation loop 130 between about 4 and about 10 times before exiting the recirculation loop. More particularly, the inventor has found that when the gas stream is recirculated through the recirculation loop 130 at about 10 times, 99.9% of particles having a size of over 5 microns are removed from the gas stream via system 100. Thus, the gas seal supply system 100, via the use of the recirculation loop 130, provides filtration characteristics that are equal to or better than conventional cartridge coalescer filter arrangements, without incurring the maintenance or size constraints associated with cartridge coalescer filter systems. The exemplary gas seal supply system 100 provides a compact in-line design capable of handling high liquid capacities, i.e., up to 30% liquid to gas mass ratio and/or up to about a 4% liquid to gas volume ratio.

When the gas stream exits the recirculation loop 130, the gas stream is routed through a heating unit 110. The heating unit 110 may be any type of heat exchanger configured to introduce heat into a gas stream, and further, in embodiments of the invention where the system 100 is implemented at a gas plant, a heat exchanger using hot exhaust gas from another process/machine as a heat source may be used to heat the gas stream in heating unit 110. Regardless of the type or configuration of heating unit 110 implemented in the present exemplary embodiment, the heating unit 110 is generally configured to heat the gas stream to a temperature sufficient to convert any condensates (if there are any) remaining in the gas stream back into a gas state, i.e., to transition any remaining condensates from a liquid to a gas state. The heating unit 110 may be used to heat the dry gas stream to any temperature desired, i.e., if a source of clean, dry, superheated gas supply is desired, then the heating unit 110 may be used to heat the dry gas stream to the desired superheated temperature. Once the gas stream has been heated by the heating unit 110, the gas stream generally exits system 100 after passing through one or more valves 112. FIG. 1 denotes the gas stream exiting system 100 at arrow 114.

FIG. 2 illustrates a high level exemplary rotary separator 202 and booster 204 that may be used in the exemplary system of FIG. 1. The combination of the separator 202 and booster 204 is denoted as system 200. The rotary separator portion 202 receives a gas stream at an input 208. The input 208 communicates the gas through a swirling nozzle or vane assembly 206 that is configured to impart a swirling motion to the gas as the gas enters the separation drum 210. The driven separation drum 210 may be rotatably mounted, and further, the separation drum 210 may be attached to a rotatable shaft 214 that is configured to drive the separation drum 210. The shaft 214 may also be used to drive the booster 204, which is generally configured to increase the pressure in the gas exiting the separator 202. The booster 204 may include rotating blades 212 driven by the shaft 214 that are configured to increase the pressure of the gas passing there through, i.e., a compressor.

Providing a driving force to the separation drum 210 provides significant advantages to the present system. For example, conventional rotary separators generally utilize the supply gas stream to generate the rotation necessary to centrifugally separate the liquid condensates from the gas stream. As such, conventional rotary separators are known to be inefficient when there is no differential pressure (no flow) to drive the rotating assembly which is the case of compressor shutdown mode or start-up mode. In at least one embodiment of the invention, the rotary separator may be driven by the shaft 214, and as such, the rotary separator may be brought up to operational speed by the shaft and not by the presser differential of the gas flow. Furthermore, the driven rotary separator may be brought up to operating speed before the wet gas stream is supplied thereto, and as such, the driven rotary separator may be configured to operate at 100% separation efficiency when the wet gas stream first enters the separator 202, thus preventing wet gas from being supplied to gas seals upon startup (as with conventional separation devices).

Figure 3:
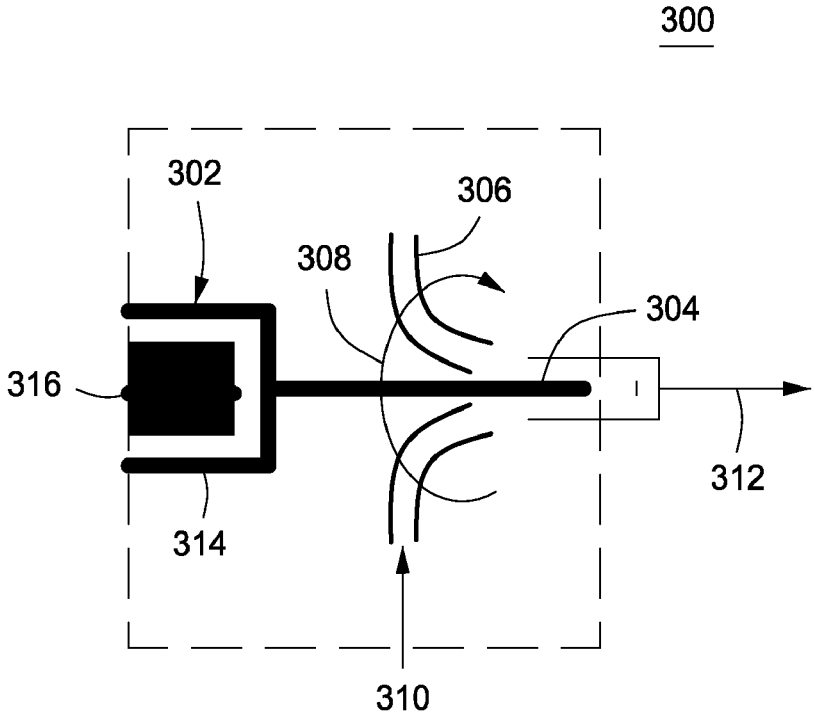
FIG. 3 illustrates an exemplary expander that may be used to drive the exemplary rotary separator and/or booster illustrated in FIGS. 1 and 2.

FIG. 3 illustrates an exemplary expander or turbine 300 that may be used to drive the exemplary rotary separator and/or booster illustrated in FIGS. 1 and 2. The expander 300 generally includes a plurality of rotating blades 306 that are configured to receive a pressurized gas at an input 310. The pressurized gas 310 causes the blades 306, which are attached to a central shaft 304, to rotate as the pressure drops across the blades 306. The rotation may, for example, be in the direction of arrow 308. Once the pressurized gas travels across the blades 306 and imparts rotation thereto, the gas may exit the expander 300 via an output 312.

The expander or turbine 300 may also include a magnetic coupling 302, which may include an outer shroud 314, which is attached to the shaft 304 and that is also magnetically coupled to an inner hub 316 for detached concomitant rotation therewith. In this configuration, as the shaft 304 and the shroud 314 rotate, the hub 316 is also caused to rotate via the magnetic coupling with the shroud 314. In one exemplary embodiment of the invention, the hub 316 may be attached to the shaft 214 of the rotary separator and/or booster system 200 to provide rotation thereto. The coupling outer hub 312 and inner hub 316 are separated by a cover which prevents any leakage from the separator/booster section to the expander section. Magnetically coupling the expander to the booster or separator operates to reduce leakage at seals that would conventionally be used with a direct shaft coupling configuration and improves the efficiency, safety, and reliability of the system.

Figure 4:
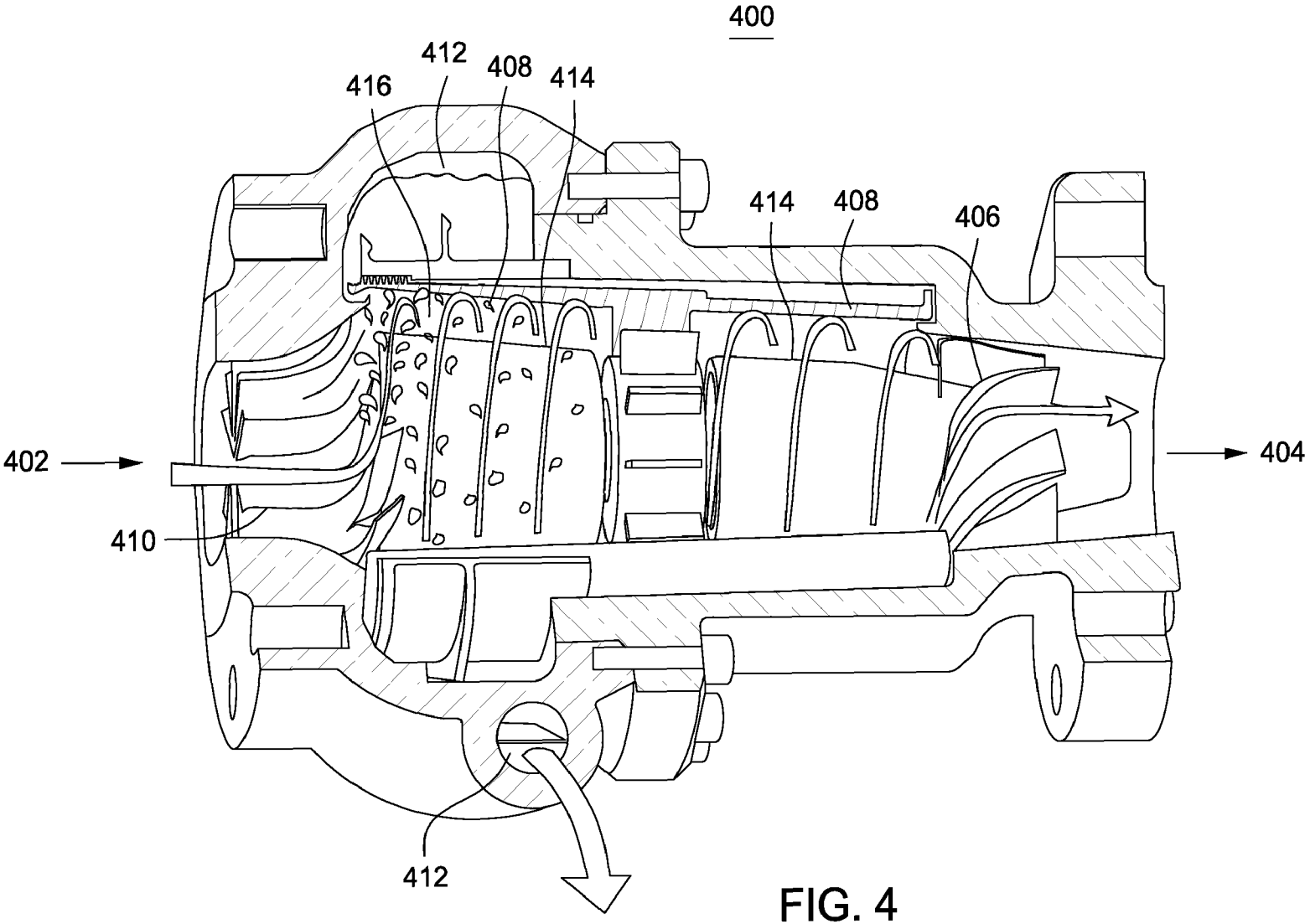
FIG. 4 illustrates a sectional view of an exemplary rotary separator that may be used in the exemplary system of the invention.

FIG. 4 illustrates a sectional view of an exemplary rotary separator 400 that may be used in the exemplary system 100 of the invention. The exemplary separator 400 generally includes a gas stream inlet 402 configured to receive a wet gas stream and transmit the wet gas stream to a plurality of guide vanes or nozzles 410, wherein the guide vanes or nozzles 410 are configured to impart a swirling motion to the wet gas stream as the gas stream enters the separator 400. The interior of the separator 400 generally includes a rotating drum 414 positioned within a separation chamber 416. The rotation of the drum 414 increases the swirling motion or circumferential velocity of the wet gas stream, and causes the wet condensates in the gas stream to be centrifugally urged outward against an outer wall 408 of the separation chamber 416. The liquid condensates are urged against the outer wall 408 and become attached thereto. The condensates travel along the slope of the outer wall 408 and are collected in an outer reservoir 412, where the liquid may be drained from the rotary separator 400. The dry gas stream spins and/or swirls through the rotary separator 400 and exits from the separator 400 at an output 404 after passing through a second set of vanes or nozzles 406 that are configured to diffuse/straighten the dry gas stream as it exits the separator 400.

Applicants note that the invention is not intended to be limited to the implementation of any particular rotary separator, and that various changes may be made to the separators illustrated herein without departing from the scope of the invention. In another exemplary embodiment of the invention, a rotary separator, such as the rotary separator described in commonly assigned U.S. Pat. No. 7,241,392, may be used in the separation system of the present disclosure. The content of the '392 patent is hereby incorporated by reference into the present disclosure to the extent that the '392 reference is not inconsistent with the present disclosure. Applicants note that the separator 10 shown in the '392 patent may be converted to a driven separator by coupling the central shaft (shown with axis "x" traveling there through in FIG. 2) of the separator 10 to a driver, as described above.

Figure 5:
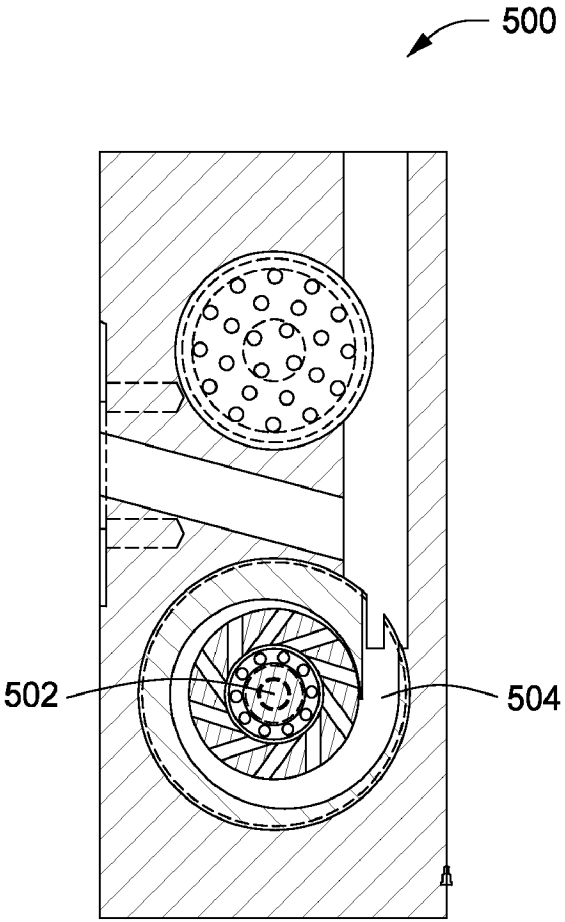
FIG. 5 illustrates a side sectional and end sectional views of an exemplary gas seal supply system of the invention implemented in a unitary housing or casing.
Figure 5:
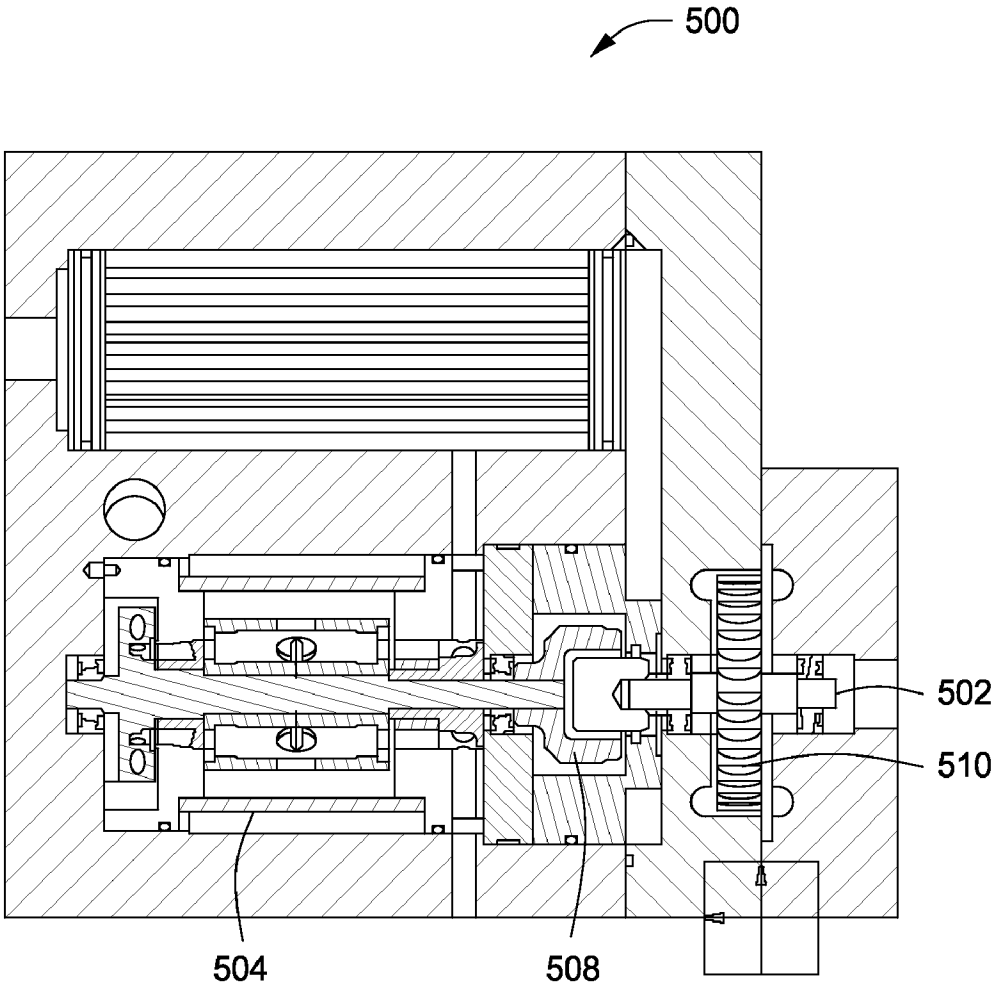

FIG. 5 illustrates a side sectional and end sectional views of an exemplary gas seal supply separation system 500 of the invention, wherein all of the components of the separator system are implemented in a unitary housing or casing. More particularly, system 500 may include an expander 510 configured to receive a pressurized gas and convert the pressure of the gas into rotational movement of a shaft 502. The shaft 502 may be magnetically coupled at 508 to a driven rotary expander 504 and/or booster, as generally described above. An advantage provided by the separation system 500 is that the entire separation system is included within a unitary housing and only requires a fraction of the space utilized by conventional gas separation machines and systems. For example, embodiments of the invention contemplate that the entire separation system 500 may be formed in a single housing or solid block casing. Additionally, gas stream heating and cooling devices, control valves, etc. may also be positioned in or flush on the unitary housing of the system 500, thus further saving on the space required to implement the exemplary system of the disclosure.

Thus, embodiments of the present invention are configured to remove liquids from gas seal buffer gas supply lines with a rotating separator, wherein the rotating separator is driven by another device, such as a motor or turbine. As such, the driven separator provides 100% efficiency at compressor stand still, during startup, whereas conventional separators have reduced separation capacity until the rotation speed comes up to a desired level, which is conventionally determined by the gas flow through the separator. By providing a driven separator, the separator can be brought up to speed prior to turning on the buffer gas supply, thus protecting the gas seals to a much higher degree than conventionally possible.

In at least one embodiment of the invention a single shaft may be driven by a small expander or turbine, which may use either the dry gas seal leakage or intermediate laby flow going to flare as the driver. Another option would be to utilize the flow of gas going to the separation seal. The purpose of using these lines is to utilize the motive force of the flare/vent gas to spin up the rotary separator prior to supplying gas to the separator. This allows the rotary separator to reach operating speed (speed for optimal separation) prior to starting the dry gas seal buffer flow. Another benefit of the current configuration is if the driven rotary separator gets hit with a slug of liquid, the separator will have the driver to maintain the appropriate operating speed and avoid separation efficiency loss that is conventionally incurred when a liquid slug is encountered by a non-driven separator. Additionally, embodiments of the present disclosure may be configured to treat a gas stream even when the receiving component of the gas, i.e., the compressor or turbo machine, is in pressurized stop mode, which is a mode where the seals for the receiving compressor or turbo machine are at most at risk of seeing condensates.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A system for supplying dry gas to machinery seals, comprising:

a gas recirculation loop, comprising:

a cooling unit configured to cool a gas stream to a temperature below a dew point of a liquid in the gas stream;

a driven rotary separator configured to receive a gas stream from the cooling unit; and a booster in communication with the driven rotary separator and configured to increase a pressure of the gas stream;

a source of rotational force in communication with the driven rotary separator;

a heating unit positioned downstream from the gas recirculation loop and configured to heat the gas stream to a temperature above the dew point of the liquid; and a control valve disposed between the booster and the heating unit, the control valve configured to move between an open position and a closed position, the control valve in the open position allowing fluid flow out of the recirculation loop and to the heating unit, and the control valve in the closed position prohibiting fluid flow to the heating unit, such that the fluid flow from the booster is recirculated back to at least one of the cooling unit, driven rotary separator, and booster.

2. The system of claim 1, wherein the heating unit and the cooling unit each comprise a heat exchanger.

3. The system of claim 1, further comprising a second control valve positioned upstream of the rotary separator, the second control valve being operable to close off a wet gas stream flow to the rotary separator until the rotary separator is operating at a desired rotation speed.

4. The system of claim 1, wherein the source of rotational force is magnetically coupled to the driven rotary separator and the coupling is canned.

5. The system of claim 1, wherein the source of rotational force comprises an expander, the expander configured transfer energy from a flow of seal gas such that the flow of seal gas drives the driven rotary separator.

6. The system of claim 1, wherein the source of rotational force comprises an expander, a turbine, or both.

7. The system of claim 6, wherein the expander or turbine is driven by a source of gas supplied at other ports of a machinery gas seal.

8. The system of claim 6, wherein the cooling unit, driven rotary separator, booster, expander, turbine, or both, and the heating unit are contained in a unitary housing.

9. A method for providing clean dry gas to gas seals in machinery, comprising:

flowing a wet gas stream through a cooling unit;

flowing the cooled wet gas stream through a driven rotary separator;

driving the driven rotary separator by passing a second flow of gas through an expander coupled to the driven rotary separator;

flowing the second flow of gas to a first gas seal;

flowing a dry gas output from the driven rotary separator through a booster;

recirculating the dry gas stream through the cooling unit, driven rotary separator, and booster until the dry gas stream reaches a desired dryness;

flowing the dry gas stream through a heating unit after the recirculation; and flowing the dry gas stream to a second gas seal.

10. The method of claim 9, wherein the cooling unit and heating unit comprise heat exchangers.

11. The method of claim 9, wherein the expander is magnetically coupled to the driven rotary separator and is canned.

12. The method of claim 9, further comprising regulating an amount of gas being recirculated in a recirculation loop with a control valve, and not allowing wet gas to enter the driven rotary separator until the driven rotary separator is at an operating speed.

13. The method of claim 9, wherein flowing the wet gas through a cooling unit comprises cooling the wet gas to a temperature below a dew point of a liquid contained in the gas so that the liquid changes state into a condensate.

14. The method of claim 9, wherein flowing the dry gas through the heating unit comprises heating the gas to change a state of any remaining liquid in the dry gas stream into a gas state.

15. The method of claim 9, wherein:

the heating unit is disposed downstream from the recirculation loop;

recirculating comprises closing a control valve disposed between the heating unit and the booster, such that fluid is prohibited from flowing from the booster to the heating unit; and flowing the dry gas stream through the heating unit comprises opening the control valve.

16. The method of claim 15, further comprising regulating an amount of gas entering the driven rotary separator to prevent gas from entering until the driven rotary separator is rotating at an operating speed.

17. A system for providing clean dry gas to gas seals for compressors, comprising:

cooling means for cooling a wet gas stream to a temperature below a dew point of a liquid in the gas to generate liquid condensates in the wet gas stream;

a driven rotary separator means for separating liquid condensates from the wet gas stream, the driven rotary separator being in communication with a source of rotational power;

a pressure boosting means for boosting the pressure of a dry gas stream exiting the driven rotary separator means;

a heating means for heating the dry gas stream to a temperature sufficient to convert any condensates in the dry gas stream into a gas state;

a recirculation loop for recirculating the dry gas stream back through the driven rotary separator means until a desired percentage of liquid condensates have been removed from the gas stream, the cooling means, driven rotary separator means, and pressure boosting means being located in the recirculation loop and the heating means being located outside of and downstream from the recirculation loop; and a first control valve positioned between the pressure boosting means and the heating means, the first control valve being configured to move between an open position and a closed position, the first control valve in the open position allowing fluid flow from the recirculation loop to the heating means, and the control valve in the closed position prohibiting fluid flow from the recirculation loop to the heating means, such that the fluid flow from the booster is recirculated back to at least one of the cooling means, driven rotary separator means, and pressure boosting means.

18. The system of claim 17, further comprising a second control valve configured to regulate an amount of gas entering the driven rotary separator means to prevent gas from entering until the driven rotary separator means is rotating at an operating speed

19. The system of claim 17, wherein the heating means and cooling means comprise heat exchangers.

20. The system of claim 17, further comprising a magnetic coupling means for magnetically coupling the driven rotary separator to the source of rotational power.

21. The system of claim 20, wherein the source of rotational power comprises at least one of an electric motor, a gas powered expander, and a turbine.

* * * * *